US008511320B2

(12) United States Patent
Sakurai et al.

(10) Patent No.: US 8,511,320 B2
(45) Date of Patent: Aug. 20, 2013

(54) FIBER BUNDLE FOR ARTIFICIAL HAIR, PROCESS FOR PRODUCING FIBER BUNDLE FOR ARTIFICIAL HAIR, AND HEAD DECORATION PRODUCT

(75) Inventors: Seiichi Sakurai, Himeji (JP); Satoru Harada, Kakogawa (JP)

(73) Assignee: Kaneka Corporation, Osaka (JP)

( * ) Notice: Subject to any disclaimer, the term of this patent is extended or adjusted under 35 U.S.C. 154(b) by 783 days.

(21) Appl. No.: 12/373,853

(22) PCT Filed: Jul. 18, 2007

(86) PCT No.: PCT/JP2007/064179

§ 371 (c)(1),
(2), (4) Date: Jan. 14, 2009

(87) PCT Pub. No.: WO2008/010515

PCT Pub. Date: Jan. 24, 2008

(65) Prior Publication Data

US 2009/0260649 A1 Oct. 22, 2009

(30) Foreign Application Priority Data

Jul. 18, 2006 (JP) ..... 2006-195484

(51) Int. Cl.
*A41G 5/00* (2006.01)
*A41G 3/00* (2006.01)

(52) U.S. Cl.
USPC ..... 132/201; 132/53

(58) Field of Classification Search
USPC ..... 132/201, 53–56
See application file for complete search history.

(56) References Cited

U.S. PATENT DOCUMENTS 4,171,001 A * 10/1979 Leonard et al. ..... 132/53
4,930,527 A * 6/1990 Makishima et al. ..... 132/201

FOREIGN PATENT DOCUMENTS

JP 09-302513 A 11/1997
JP 10-295942 A 11/1998
WO 2005/044031 A1 5/2005
WO 2005/110136 A1 11/2005

* cited by examiner

*Primary Examiner* — Rachel Steitz
(74) *Attorney, Agent, or Firm* — Sughrue Mion, PLLC

(57) ABSTRACT

An object of the invention is to provide an artificial hair fiber bundle having a color tone with a gradation appearance at a tip portion thereof. An aspect of the invention is a fiber bundle (10) for artificial hair, with one end (1) thereof being bundled and fixed. The fiber bundle includes fibers (A1, B1) of two or more kinds having color tones different from each other, the fiber bundle being obtained by a heat treatment at a predetermined temperature. The fibers of two or more kinds have heat shrinkage rates different from each other, and a tip portion of the fiber (A1) out of the fibers of two or more kinds emerges in a portion (2) corresponding to the other end of the fiber bundle (10) which is not bundled and fixed.

16 Claims, 2 Drawing Sheets

FIBER BUNDLE FOR ARTIFICIAL HAIR, PROCESS FOR PRODUCING FIBER BUNDLE FOR ARTIFICIAL HAIR, AND HEAD DECORATION PRODUCT

TECHNICAL FIELD

The present invention relates to a fiber bundle for artificial hair, a process for producing a fiber bundle for artificial hair, and a head decoration product. More specifically, the present invention relates to an artificial hair fiber bundle having a color tone with a gradation appearance at a tip portion thereof, a process for producing an artificial hair fiber bundle, and a head decoration product.

BACKGROUND ART

Conventionally, there is known a fancy hair dyeing method called TIP color, comprising changing a color tone of only a tip portion of hair, to provide an peculiar appearance. The TIP color provides a fancy appearance such as having a color tone change of a gradation effect of gradually changing the color toward a tip portion of hair.

As a method for imparting a color to a head of the user without directly dyeing the hair, there is known a method of attaching a hair ornament called an extension to a head of the user. A colored extension is obtained by forming an artificial hair fiber bundle constituted of colored synthetic fibers or a like material.

Whereas multitudes of kinds of colored extensions are well-known, there is scarcely known an extension having TIP color, i.e. an extension having a color tone change with a gradation appearance.

As a technique of stepwise changing the color tone of an artificial hair fiber bundle, for instance, patent document 1 describes a doll's hair fiber which is produced by applying different color dyeing liquids, as an aqueous medium, to an intended portion to be dyed of a fiber bundle being bundled and fixed of one end thereof; and subjecting the portion of the fiber bundle to dielectric heating using a high-frequency electric field in a state that the dyeing liquids are un-dried to dye the portion applied with the dyeing liquids.

In the case where a fiber preliminary dyed with a certain color is partially dyed with another color according to the above process, there is a drawback that color controlling may be difficult due to an influence of the original color of the fiber preliminary dyed with the certain color. Also, a boundary portion of the dyed portions of the hair fiber obtained by the above process is not sufficiently gradated, and an intended color tone change or gradation may not be obtained.

Patent document 1: JP Hei 10-295942A

DISCLOSURE OF THE INVENTION

In view of the above, it is an object of the invention to provide an artificial hair fiber bundle having a color tone change with gradation appearance at a tip portion thereof.

An aspect of the invention is a fiber bundle for artificial hair, with one end thereof being bundled and fixed, the fiber bundle comprising: fibers of two or more kinds being heat-treated at a predetermined temperature and having color tones different from each other, wherein the fibers of two or more kinds have heat shrinkage rates different from each other, and a tip portion of a fiber of one kind out of the fibers of two or more kinds emerges in a portion corresponding to the other end of the fiber bundle which is not bundled and fixed.

These and other objects, features and advantages of the present invention will become more apparent upon reading of the following detailed description along with the accompanying drawings.

BEST MODE FOR CARRYING OUT THE INVENTION

In the following, an embodiment of the invention is described referring to the accompanying drawings. The embodiment is merely an example embodying the invention, and does not limit the technical scope of the invention.

Figure 1:
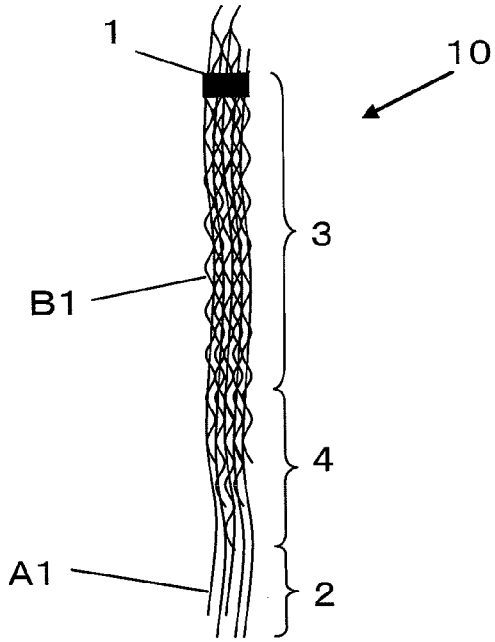
FIG. 1 is a schematic diagram showing a fiber bundle after a heat treatment has been performed in an embodiment of the invention.

FIG. 1 is a schematic diagram showing an artificial hair fiber bundle 10 in accordance with an embodiment of the invention. In FIG. 1, A1 is a fiber having a low heat shrinkage rate, and B1 is a fiber having a high heat shrinkage rate. The fibers A1 and the fibers B1 have color tones different from each other.

The fiber bundle 10 is bundled and fixed at a fixing portion 1. The fibers B1 are shrunk or crimped by heat treatment. A tip portion of the fibers A1 emerges in a portion 2 corresponding to the other end of the fiber bundle 10 which is not bundled and fixed. The term "emerge" in the specification means that the non-fixed end portion of the fiber bundle 10 constituted of the fibers (A1, B1) of two kinds is consists solely of the fibers A1 having a small heat shrinkage rate. Similarly to the above, in the case where a fiber bundle is constituted of fibers of three or more kinds, the term "emerge" means that the end portion of the fiber bundle consists solely of fibers having a small heat shrinkage rate, out of the fibers of three or more kinds.

The fiber bundle 10 includes a portion 3 where the fibers A1 are present in full amount and the fibers B1 are present in full amount, the portion 2 where solely the fibers A1 are present, and a portion 4 where the fibers A1 are present in full amount, and the fibers B1 are partially present, between the portion 2 and the portion 3. In the portion 4, the amount of the fibers B1 is gradually decreased toward the tip of the fiber bundle 10. The portion 4 is a portion where the color tone of the tip portion of the fiber bundle 10 is gradually changed from the color tone in the portion 3 to the color tone in the portion 2.

Figure 2:
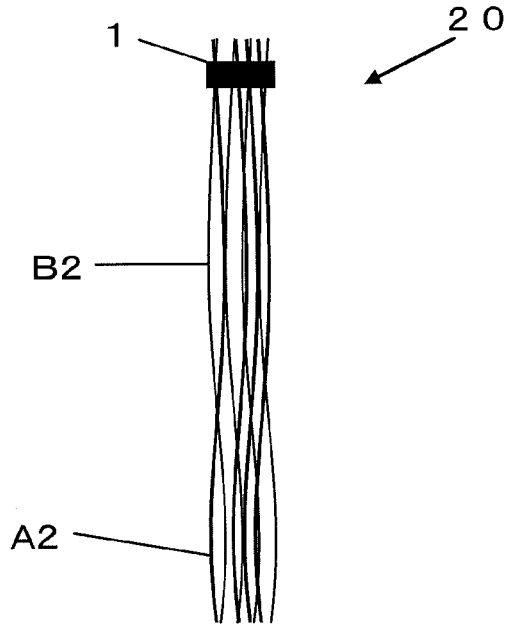
FIG. 2 is a schematic diagram showing a fiber bundle before a heat treatment is performed in the embodiment of the invention.

The fiber bundle 10 is obtained by subjecting a fiber bundle 20 as shown in FIG. 2 to a heat treatment at a predetermined temperature.

The fiber bundle 20 is a fiber bundle which is bundled and fixed at a fixing portion 1, and is constituted of fibers A2 having a low heat shrinkage rate, and fibers B2 having a high heat shrinkage rate, wherein the fibers A2 and the fibers B2 have color tones different from each other.

The fiber bundle 10 is obtained by subjecting the fiber bundle 20 to a heat treatment at a predetermined temperature to shrink or crimp the fibers A2 and the fibers B2 depending on the respective corresponding heat shrinkage rates, whereby a tip portion of the fibers A2 emerges in a portion corresponding to the other end of the fiber bundle 20 which is not bundled and fixed. In the fiber bundle 10 obtained by the above process, the positions of the fiber tips are displaced inartificially one from another by shrinking or crimping the fibers B1, whereby, the portion 4, where the color tone of the fibers A1 and the color tone of the fibers B1 are apparently mixed, is formed between the exposing fibers A1, and the crimped fibers B1. In the case where the fibers A1 are crimped by subjecting the fiber bundle 20 to a heat treatment, the fibers B1 are pulled in the direction toward the fixing portion 1 in a state that the fibers B1 are entangled with the fibers A1, whereby, the boundary of colors are ill-defined, and enhanced gradation appearance is provided.

The artificial hair fiber bundle in the embodiment is produced by e.g. performing the following operations.

First, a fiber bundle constituted of fibers of two or more kinds having heat shrinkage rates different from each other, and color tones different from each other with one end of the fiber bundle being bundled and fixed is subjected to a heat treatment at a predetermined temperature, to shrink or crimp the fibers of two or more kinds depending on the respective corresponding heat shrinkage rates.

The heat shrinkage rate is obtained by the following formula (1):

$$\text{heat shrinkage rate}(\%)=(L1-L2)/L1\times 100 \quad (1)$$

where L1 is a length of a fiber bundle having a total fineness of 10,000 dtex under a load of $9.8\times10^{-5}$N/dtex; and L2 is a length of the fiber bundle under a load of $9.8\times10^{-5}$N/dtex at a room temperature after heat treatment in a predetermined heat treatment condition in a state that the load to the fiber bundle is released.

The heat treatment condition to be employed in measuring a heat shrinkage rate may be optionally selected depending on the kind of fiber, the fineness of fiber, or the like. For instance, it is preferable to select a dry heat condition at about 80 to 150° C., or a wet heat condition at about 70 to 100° C.

Preferably, a fiber bundle to be subjected to a heat treatment includes fibers of at least two kinds having color tones different from each other and having a difference in heat shrinkage rate of 4% or more and more preferably 10% or more in a heat treatment condition of a predetermined temperature to provide enhanced gradation appearance.

Concerning a color tone difference between the fibers having the different heat shrinkage rates, a color difference (ΔE) is preferably 1 or more, more preferably 15 or more, particularly preferably 18 or more, and preferably 95 or less, and more preferably 90 or less to provide enhanced gradation appearance, because enabling a person to sufficiently recognize a color tone difference by ordinary visual observation.

The color difference (ΔE) is a color difference based on the L*a*b* color system (CIE1976L*a*b* color space) defined by the International Committee on Illumination (CIE), and is calculated by the following formula:

$$\Delta E=[(\Delta L^*)^2+(\Delta a^*)^2+(\Delta b^*)^2]^{1/2}$$

The L*a*b* color system is a color coordinate system on a color mixing system, wherein L* represents lightness, a* represents a red-green chromaticity axis, and b* represents a yellow-blue chromaticity axis. A color difference between two colors is calculated, as shown by the above formula, by a square root of square sum of differential values of each of L* value, a* value, and b* value. The color system is widely used in measuring a color difference for color control in the industrial field in Japan, and with use of the color coordinate system, a color difference value analogous to human sensation is provided with respect to a color at any coordinate position in the color space used in the industrial field.

The color difference (ΔE) between fibers of two kinds is obtained by measuring the fibers of two kinds, with use of a spectrophotometer (e.g. a spectrophotometer CM-2600d (8 mm of calorimetric diameter) of Konica Minolta Sensing, Inc.) in SCI (specular component included) mode.

In the case where fibers of two or more kinds are combined, there is no specific limitation as to which fiber has a dark color. However, it is preferable to define a fiber having a high heat shrinkage rate as a fiber of a dark color, and a fiber having a low heat shrinkage rate as a fiber of a light color. This arrangement enables to provide a head decoration product such as an extension with enhanced gradation, because a portion where color tones of fibers of two or more kinds are mixed has a dark color tone, and the color tone gradually becomes lighter toward a tip of the extension. The terms "light color" and "dark color" have relative definitions defined by human sensation, and it is difficult to precisely define the terms. Generally, as far as fibers are dyed with an identical dye, the color of a fiber whose dye concentration is relatively small e.g. 0.2% or less is called as a "light color", and the color of a fiber whose dye concentration is relatively large e.g. 0.6% or more is called as a "dark color".

Examples of a fiber constituted of the fibers of two or more kinds are synthetic fibers including modacrylic-based fibers, and polyamide-based fibers such as nylon-based fibers, halogen-based fibers such as vinyl chloride-based fibers and vinylidene chloride-based fibers, polyester-based fibers, and polyolefin-based fibers such as polyethylene-based fibers and polypropylene-based fibers, vinylon-based fibers, and polyurethane-based fibers; natural fibers including human hair, animal hair (such as wool), cotton fibers, linen fibers, and silk fibers; regenerated fibers including rayon-based fibers, polynosic-based fibers, cupra-based fibers, and regenerated collagen fibers; and semi-synthetic fibers including acetate-based fibers and triacetate-based fibers. Among these, including a modacrylic-based fiber as a fiber of at least one kind of a fiber constituted of the fibers of two or more kinds is preferable to obtain a desirable touch sensation, texture, luster, and color similar to those of human hair, and obtain a heat shrinkage rate in a wide range.

Various additives such as a flame retardant, a heat resistant agent, a light stabilizer, a fluorescent agent, an antioxidant, an antistatic agent, a pigment, a plasticizer, and a lubricant are added to the aforementioned fibers, as necessary.

The synthetic fiber among the aforementioned fibers is normally produced by a solution spinning method or a melt spinning method. Examples of a coloring method in the embodiment are a coloring method (hereinafter, also called as a "spin-coloring method") comprising adding a dye or a pigment in a solution spinning step or a melt spinning step; and a coloring method (hereinafter, also called as a "dyeing method") comprising a dyeing step, followed by a solution spinning step or a melt spinning step of producing fibers. It is preferable to produce a fiber of at least one kind out of the fibers of two or more kinds to be used in the invention by coloring according to the spin-coloring method for easily controlling the heat shrinkage rate, and suppressing fiber property deterioration resulting from a hot water treating step or a like step in the dyeing method.

As far as the fibers of two or more kinds have a monofilament fineness satisfying a requirement on a monofilament fineness to be used in a conventional artificial hair fiber, the monofilament fineness of the fibers of two or more kinds is not specifically limited. However, the monofilament fineness is preferably from about 25 to 95 dtex, and more preferably from about 30 to 80 dtex to keep a touch sensation and texture similar to those of human hair.

Preferred examples of combination in the fibers of two or more kinds are: combination of modacrylic-based fibers, combination of a modacrylic-based fiber and a polyamide-based fiber, combination of a modacrylic-based fiber and a halogen-based fiber, combination of a modacrylic-based fiber and a polyester-based fiber, and combination of a modacrylic-based fiber and human hair/animal hair, wherein a color difference (ΔE) is 1 or more, and a difference in dry heat shrinkage rate to be obtained by subjecting the fibers to dry heat at 100° C. is 4% or more. Among the above examples, combination of modacrylic-based fibers is preferably used.

It is difficult to strictly specify the content ratio of the fibers of two or more kinds constituting a fiber bundle to be subjected to heat treatment, because a gradation degree differs depending on a magnitude of color difference (ΔE). In the case where fibers of two kinds whose color difference (ΔE) is from about 10 to 20 are combined, it is preferable to contain fibers of a light color out of the fibers of two kinds in the amount of 5 to 95 mass %, and more preferably 10 to 90 mass % with respect to the total content in a fiber bundle.

One end of the fiber bundle is bundled and fixed by stitching, welding, clipping, weft stitching, or a like fixing process.

Preferably, the total fineness of the fiber bundle 10 is about 100,000 to 2,000,000 dtex.

Preferred examples of a method of subjecting a fiber bundle to a heat treatment are a method of subjecting a fiber bundle to dry heat at a temperature of about 85 to 150° C., and a method of subjecting a fiber bundle to wet heat at a temperature of about 70 to 100° C. A heat treating period is preferably about 5 to 40 minutes, and more preferably about 15 to 30 minutes.

Performing the above heat treatment enables to produce an artificial hair fiber bundle having a color tone with a gradation appearance at a tip portion thereof in the embodiment.

A tip portion of fibers of one kind out of the fibers of two or more kinds constituting the heat-treated artificial hair fiber bundle is exposed preferably by 0.5 cm or more, and more preferably by 1 cm or more. Exposing fibers having a specific color tone at a tip portion of a fiber bundle by the aforementioned length is advantageous in providing an enhanced gradation effect.

In the case where the heat-treated fiber bundle constituted of the fibers of two or more kinds having different heat shrinkage rates, and different color tones is subjected to dry heat at 130° C., preferably, the fiber bundle has a difference in dry heat shrinkage rate (a difference in remaining shrinkage rate) of 5% or more, and more preferably 10% or more. Judgment as to whether a fiber bundle is the inventive fiber bundle can be made by judging whether the fiber bundle satisfies the above-mentioned requirement on the difference in remaining shrinkage rate.

The artificial hair fiber bundle obtained by the above process is used as a head decoration product such as an extension, a wig, a hairpiece, a braid, a doll hair, or a whole wig; and particularly preferably used as an extension, a wig, or a like article requiring enhanced decoration property and good appearance.

In the following, the invention is described by way of Examples in detail, but the invention is not limited to Examples.

EXAMPLES

Production Example 1

To 100 mass parts of acetone, dissolved was 29.5 mass parts of a co-polymerized resin containing 49 mass % of acrylonitrile, 50 mass % of vinyl chloride, and 1 mass % of sodium styrene sulfonate, as monomer units, and then, 0.5 mass part of carbon black, 0.07 mass part of a red dye and 0.35 mass part of a yellow dye as a cationic liquid dye (product of Hodogaya Kagaku K.K.) were added. Thereby, a spinning solution of 27.5 mass % in solid concentration was prepared.

The spinning solution was blown into a 20 mass % acetone aqueous solution of 20° C. at a nozzle draft of 1.1, with use of a wet spinning apparatus having a dumbbell-shaped spinning nozzle, to produce fibers, and then, the fibers were drawn to a length 1.5 times, while releasing the solvent in a water washing bath at 60° C. and the fibers were dried at 130° C. Then, the dried fibers were subjected to dry heat drawing to a length 2.5 times at 120° C., whereby a modacrylic fiber (hereinafter, called as a "modacrylic fiber A") having a monofilament fineness of 55.6 dtex, a dry heat shrinkage rate of 13.3%, and a black hue (L*=18.8, a*=0.6, b*=1.3) was obtained.

The hue of the fibers was measured with use of a spectrophotometer CM-2600d (8 mm of colorimetric diameter) of Konica Minolta Sensing, Inc. in SCI (specular component included) mode.

The dry heat shrinkage rate of the obtained fibers was measured by the following method.

The length (L1) of a fiber bundle (total fineness: 10,000 dtex) of the obtained fibers was measured under a load of $9.8\times10^{-5}$N/dtex. Then, the length (L2) of the fiber bundle under a load of $9.8\times10^{-5}$N/dtex was measured after the fiber bundle in a state that the load is released was put in a convection oven at 100° C. for 30 minutes to shrink the fibers and then lowering temperature to room temperature. The dry heat shrinkage rate of the fiber bundle was calculated by the following formula (2).

$$\text{dry heat shrinkage rate}(\%)=(L1-L2)/L1\times100 \quad (2)$$

Production Examples 2 Through 6

Modacrylic fibers (hereinafter, called as "modacrylic fibers B through F") having the dry heat shrinkages and the hues as recited in Table 1 were obtained in the similar manner as in Production Example 1, except that the coloring agent composition, the spinning nozzle type, the nozzle draft, the acetone aqueous solution, and the dry heat drawing condition as recited in Table 1 were employed.

Production Examples 7 Through 12

Modacrylic fibers (hereinafter, called as "modacrylic fibers G through L") having the dry heat shrinkages and the hues as recited in Table 1 were obtained in the similar manner as in Production Example 1, except that the coloring agent composition, the spinning nozzle type, the nozzle draft, the acetone aqueous solution, and the dry heat drawing condition as recited in Table 1 were employed and that the fibers were subjected to a heat treatment for relax in a convection oven in the conditions as recited in Table 2.

Production Example 13

A modacrylic fiber having a monofilament fineness of 55.6 dtex was obtained by a solution spinning method using a spinning solution prepared in the similar manner as in Production Example 1, except that a coloring agent was not used.

Then, the modacrylic fibers were dyed by an Obermeier dyeing machine to obtain a brown hue (No. 130), and then, the fibers were dried at 80° C., whereby the modacrylic fiber M having the property as recited in Table 1 was obtained. As a result of measuring a dry heat shrinkage rate of the modacrylic fiber M, the dry heat shrinkage rate was 1.6%.

Production Example 14

80 parts of polyethylene terephthalate (BK-2180 of Mitsubishi Chemical Corporation), 20 parts of polyarylate (U-100 of Unitika, Ltd.), and 0.3 part of sodium stearate were dry-blended, and the mixture was fed to a twin screw extruder at a cylinder temperature of 300° C. for melt-kneading, And then, a strand extruded from the twin screw extruder was subjected to pelletization while being cooled. The obtained pellets were dried until the water content rate of 100 ppm or less was attained.

Then, the pellets were supplied to a melt spinning machine equipped with a spinneret having a nozzle pores with a circular section shape to extruded a molten polymer, whereby un-drawn filaments were obtained. The un-drawn filaments were drawn in a warm water bath of 90° C., and then, drawn to a length 5 times in a warm water bath of 100° C. Then, the filaments were subjected to a heat treatment by a heated roll of 200° C., whereby, polyester fibers having a monofilament fineness of 50 dtex were obtained.

TABLE 1

| PRODUCTION EX | KIND OF FIBER | COLORING AGENT COMPOSITION (MASS %) CARBON BLACK | RED DYE | YELLOW DYE | SPINNING NOZZLE TYPE | NOZZLE DRAFT | AQUEOUS SOLUTION OF ACETONE |
|---|---|---|---|---|---|---|---|
| 1 | MODACRYLIC FIBER A | 0.5 | 0.07 | 0.35 | DUMBBELL SHAPE | 1.1 | 20%, 20° C. |
| 2 | MODACRYLIC FIBER B | 0.4 | 0.1 | 0.32 | Y SHAPE | 1.2 | 25%, 18° C. |
| 3 | MODACRYLIC FIBER C | 0.24 | 0.06 | 0.22 | DUMBBELL SHAPE | 1.1 | 20%, 20° C. |
| 4 | MODACRYLIC FIBER D | 0.06 | 0.05 | 0.19 | DUMBBELL SHAPE | 1.1 | 20%, 20° C. |
| 5 | MODACRYLIC FIBER E | 0 | 0.04 | 0.17 | DUMBBELL SHAPE | 1.1 | 20%, 20° C. |
| 6 | MODACRYLIC FIBER F | 0.06 | 0.16 | 0.36 | DUMBBELL SHAPE | 1.1 | 20%, 20° C. |
| 7 | MODACRYLIC FIBER G | 0.1 | 0.03 | 0.13 | DUMBBELL SHAPE | 1.4 | 20%, 18° C. |
| 8 | MODACRYLIC FIBER H | 0.07 | 0.02 | 0.09 | DUMBBELL SHAPE | 1.4 | 20%, 18° C. |
| 9 | MODACRYLIC FIBER I | 0.19 | 0.15 | 0.32 | HORSESHOE SHAPE | 1.4 | 20%, 18° C. |
| 10 | MODACRYLIC FIBER J | 0.07 | 0.25 | 0.07 | DUMBBELL SHAPE | 1.4 | 20%, 18° C. |
| 11 | MODACRYLIC FIBER K | 0.4 | 0.05 | 0.34 | Y SHAPE | 1.2 | 25%, 18° C. |
| 12 | MODACRYLIC FIBER L | 0.4 | 0.1 | 0.32 | Y SHAPE | 1.2 | 25%, 18° C. |
| 13 | MODACRYLIC FIBER M | — | — | — | DUMBBELL SHAPE | 1.4 | 20%, 18° C. |
| 14 | POLYESTER FIBER | 0.09 | 0.09 | 0.27 | ROUND SHAPE | — | — |

| PRODUCTION EX | DRAWING RATIO BY WET SPINNING DRAWING (TIMES) | DRY HEAT DRAWING CONDITION | HEAT TREATMENT FOR RELAX | DRY HEAT SHRINKAGE RATE (%) | HUE L* | a* | b* | COLOR — |
|---|---|---|---|---|---|---|---|---|
| 1 | 1.5 | 120° C., 2.5 TIMES | NO TREATMENT | 13.3 | 18.8 | 0.6 | 1.3 | BLACK |
| 2 | 1.5 | 120° C., 2.5 TIMES | NO TREATMENT | 12.5 | 19.3 | 1.4 | 1.7 | BLACK |
| 3 | 1.5 | 120° C., 2.5 TIMES | NO TREATMENT | 15.1 | 21.3 | 2.6 | 3.6 | DARK BLUE |
| 4 | 1.5 | 120° C., 1.8 TIMES | NO TREATMENT | 5.3 | 33.8 | 12.9 | 17.8 | BROWN |
| 5 | 1.5 | 120° C., 2.5 TIMES | NO TREATMENT | 13.3 | 45.5 | 9.1 | 24.8 | BEIGE |
| 6 | 1.5 | 120° C., 2.5 TIMES | NO TREATMENT | 13.3 | 24.5 | 14.7 | 9.4 | CHESTNUT BROWN |
| 7 | 1.5 | 120° C., 2.5 TIMES | 145° C., 3 MIN | 1.5 | 30.9 | 5.5 | 11.2 | BLUISH BROWN |
| 8 | 1.5 | 120° C., 2.5 TIMES | 150° C., 3 MIN | 1.1 | 37 | 5.7 | 13.2 | BLUISH BROWN |
| 9 | 1.5 | 120° C., 2.8 TIMES | 130° C., 3 MIN | 4.2 | 21.4 | 6 | 4.5 | DARK PURPLE |

TABLE 1-continued

| | | | | | | | | |
|---|---|---|---|---|---|---|---|---|
| 10 | 1.5 | 140° C., 2.5 TIMES | 155° C., 3 MIN | 3.5 | 27.4 | 22 | 5.2 | PURPLE |
| 11 | 1.5 | 120° C., 2.5 TIMES | 155° C., 3 MIN | 2.0 | 19.3 | 1.4 | 1.7 | BLACK |
| 12 | 1.5 | 120° C., 2.5 TIMES | 155° C., 3 MIN | 2.0 | 19.3 | 1.4 | 1.7 | BLACK |
| 13 | 1.5 | 120° C., 2.5 TIMES | NO TREATMENT | 1.6 | 34 | 13.5 | 17.6 | BROWN |
| 14 | — | — | — | 0.6 | 27.7 | 12.2 | 11.9 | BROWN |

The following evaluation was performed with respect to the fibers produced as described above.

Examples 1 Through 13, and Comparative Examples 1 Through 5

The fibers obtained in Production Examples 1 through 14 were mixed with the fiber composition as recited in Tables 2 and 3. The mixed fibers were sufficiently combed with a comb, and a fiber bundle having a total fineness of 3,800,000 dtex was obtained. One end of the fiber bundle was bundled and fixed by weft stitching, and the other end thereof was cut to a predetermined length. Thereby, artificial hair fiber bundles each having a length of 30 cm were obtained.

The artificial hair fiber bundles were put in a convection oven of 100° C. for 30 minutes, whereby, heat-treated fiber bundles were obtained.

The heat-treated fiber bundles were evaluated by the following method.

(Color Difference Between Fibers)

A color difference between mixed fibers having different colors was calculated by the following formula, using the values based on the L*a*b* color coordinate system (CIE1976L*a*b* color space) defined by the International Committee on Illumination (CIE):

$$\Delta E=[(\Delta L^*)^2+(\Delta a^*)^2+(\Delta b^*)^2]^{1/2}$$

(Remaining Shrinkage Rate, and Difference in Remaining Shrinkage Rate)

A dry heat shrinkage rate of the individual fibers constituting each of the heat-treated fiber bundles obtained by subjecting the fiber bundles to dry heat in a convection oven of 130° C. for 10 minutes was measured, and the dry heat shrinkage rate was defined as a remaining shrinkage rate. An absolute value of a difference in remaining shrinkage rate between the fibers was defined as a difference in remaining shrinkage rate. In the case where a fiber bundle is constituted of fibers of three or more kinds, a difference in remaining shrinkage rate between a fiber having a maximum remaining shrinkage rate, and a fiber having a minimum remaining shrinkage rate was defined as a difference in remaining shrinkage rate.

(Difference in Length of Tip Portion)

A difference in length of a tip portion of the individual fibers constituting each of the heat-treated fiber bundles was measured. The measurement was performed by: measuring a difference in length of a tip portion between a fiber having a small shrinkage rate and a longest fiber length, and a fiber having a large shrinkage rate and a shortest fiber length with respect to each of ten heat-treated fiber bundles; and calculating an average of the differences.

(Evaluation on Gradation Appearance by Visual Observation)

Gradation appearances of color tone of the tip portions of the fiber bundles were evaluated by the following criteria. The symbols "A" and "B" indicate PASSED, and the symbols "C" and "D" indicate FAILED.

A: A color tone with enhanced gradation appearance was observed.

B: A color tone with proper gradation appearance was observed.

C: A color tone change was observed, but a gradation appearance was not observed.

D: A color tone change at the tip portion of the fiber bundle was not observed.

(Color Difference of Gradated Portion)

A portion corresponding to a non-fixed end of each of the fiber bundles was observed and a color differences were measured between hues of a portion of each of the fiber bundles where gradation was visually recognized (corresponding to the portion 4 in FIG. 1), and hues of a tip portion of each of the fiber bundles where gradation was not visually recognized (corresponding to the portion 2 in FIG. 2). In the case where gradation was not visually recognized, measurement was not performed, assuming that the fiber bundle did not have a gradated portion.

(Color Difference of Non-Gradated Portion)

Hues of a portion at a fixed end of each of the fiber bundles where no gradation was visually recognized (corresponding to the portion 3 in FIG. 1) and a portion at a non-fixed end of each of the fiber bundles where no gradation was visually recognized (corresponding to the portion 2 in FIG. 2) were measured. A color difference between the portions was calculated with respect to each of the fiber bundles.

(Color Tone Appearance)

Color tones of the tip portions of the fiber bundles were visually observed. In Table 2, for instance, the indication "black→brown" expresses that the color turns from black to brown toward the tip portion.

(Crimp Appearance)

A degree of crimp and an apparent height of fiber bundles were visually observed, and an evaluation were made based on the following criteria.

The symbols "A" and "B" indicate PASSED, and the symbols "C" and "D" indicate FAILED.

A: The fibers in the fiber bundle are uniformly crimped, and the fiber bundle has a large body.

B: The fibers in the fiber bundle are uniformly crimped, and the fiber bundle has a medium body.

C: The fibers in the fiber bundle are not uniformly crimped, and the fiber bundle has a small body.

D: The fibers in the fiber bundle are not uniformly crimped, with a small crimping degree, and the fiber bundle has a poor body.

An evaluation result is shown in Tables 2 and 3.

TABLE 2

| | KIND OF FIBER | DRY HEAT SHRINKAGE RATE (%) | REMAINING SHRINKAGE RATE (%) | EXAMPLE 1 | EXAMPLE 2 | EXAMPLE 3 |
|---|---|---|---|---|---|---|
| FIBER COMPOSITION (MASS PARTS) | MODACRYLIC FIBER A | 13.3 | 15.1 | 50 | — | — |
| | MODACRYLIC FIBER B | 12.5 | 13 | — | 60 | — |
| | MODACRYLIC FIBER C | 15.1 | 17.8 | — | — | 55 |
| | MODACRYLIC FIBER D | 5.3 | 6.2 | — | — | — |
| | MODACRYLIC FIBER E | 13.3 | 14.8 | — | — | — |
| | MODACRYLIC FIBER F | 13.3 | 14.6 | — | — | — |
| | MODACRYLIC FIBER G | 1.5 | 2 | — | — | — |
| | MODACRYLIC FIBER H | 1.1 | 1.1 | — | 40 | — |
| | MODACRYLIC FIBER I | 4.2 | 3.3 | — | — | 45 |
| | MODACRYLIC FIBER J | 3.5 | 2.1 | — | — | — |
| | MODACRYLIC FIBER K | 2.0 | 1.5 | — | — | — |
| | MODACRYLIC FIBER L | 2.0 | 1.7 | 50 | — | — |
| | MODACRYLIC FIBER M | 1.6 | 3.0 | — | — | — |
| | POLYESTER FIBER | 0.6 | 1.1 | — | — | — |
| COLOR DIFFERENCE BETWEEN FIBERS (ΔE) | | | | 1.0 | 21.5 | 18.7 |
| DIFFERENCE IN REMAINING SHRINKAGE RATE (%) | | | | 13.4 | 11.9 | 14.5 |
| DIFFERENCE IN TIP PORTION LENGTH (cm) | | | | 2.8 | 2.9 | 2.4 |
| GRADATION APPEARANCE | | | | B | A | A |
| COLOR DIFFERENCE OF NON-GRADATED PORTION (ΔE) | | | | 0.7 | 10.4 | 1.3 |
| COLOR DIFFERENCE OF GRADATED PORTION (ΔE) | | | | 0.5 | 5.1 | 1 |
| COLOR TONE APPEARANCE | | | | BLACK→PALE BLACK | BLACK→PALE BROWN | DARK BLUE→PURPLE |
| CRIMP APPEARANCE | | | | A | A | A |
| DIFFERENCE IN DRY HEAT SHRINKAGE RATE (%) | | | | 11.3 | 11.4 | 10.9 |

| | KIND OF FIBER | DRY HEAT SHRINKAGE RATE (%) | REMAINING SHRINKAGE RATE (%) | EXAMPLE 4 | EXAMPLE 5 | EXAMPLE 6 | EXAMPLE 7 |
|---|---|---|---|---|---|---|---|
| FIBER COMPOSITION (MASS PARTS) | MODACRYLIC FIBER A | 13.3 | 15.1 | — | — | — | 70 |
| | MODACRYLIC FIBER B | 12.5 | 13 | — | — | — | — |
| | MODACRYLIC FIBER C | 15.1 | 17.8 | — | — | — | — |
| | MODACRYLIC FIBER D | 5.3 | 6.2 | 70 | — | — | — |
| | MODACRYLIC FIBER E | 13.3 | 14.8 | — | 50 | — | — |
| | MODACRYLIC FIBER F | 13.3 | 14.6 | — | — | 40 | — |
| | MODACRYLIC FIBER G | 1.5 | 2 | — | — | — | — |
| | MODACRYLIC FIBER H | 1.1 | 1.1 | 30 | — | — | — |
| | MODACRYLIC FIBER I | 4.2 | 3.3 | — | — | — | — |
| | MODACRYLIC FIBER J | 3.5 | 2.1 | — | 50 | — | — |
| | MODACRYLIC FIBER K | 2.0 | 1.5 | — | — | — | — |
| | MODACRYLIC FIBER L | 2.0 | 1.7 | — | — | — | — |
| | MODACRYLIC FIBER M | 1.6 | 3.0 | — | — | 60 | — |
| | POLYESTER FIBER | 0.6 | 1.1 | — | — | — | 30 |
| COLOR DIFFERENCE BETWEEN FIBERS (ΔE) | | | | 9.1 | 29.6 | 10.5 | 18 |
| DIFFERENCE IN REMAINING SHRINKAGE RATE (%) | | | | 5.1 | 12.1 | 11.6 | 14 |
| DIFFERENCE IN TIP PORTION LENGTH (cm) | | | | 0.5 | 1.3 | 3.2 | 4.2 |
| GRADATION APPEARANCE | | | | B | A | B | A |
| COLOR DIFFERENCE OF NON-GRADATED PORTION (ΔE) | | | | 5.8 | 14.7 | 5.4 | 11.3 |
| COLOR DIFFERENCE OF GRADATED PORTION (ΔE) | | | | 2.8 | 5.6 | 2.2 | 4.8 |
| COLOR TONE APPEARANCE | | | | BROWN→ BLUISH BROWN | BEIGE→ PURPLE | CHESTNUT BROWN→ BROWN | BLACK→ BROWN |
| CRIMP APPEARANCE | | | | B | A | A | A |
| DIFFERENCE IN DRY HEAT SHRINKAGE RATE (%) | | | | 4.2 | 9.8 | 11.7 | 12.7 |

| | KIND OF FIBER | DRY HEAT SHRINKAGE RATE (%) | REMAINING SHRINKAGE RATE (%) | EXAMPLE 8 | EXAMPLE 9 | EXAMPLE 10 |
|---|---|---|---|---|---|---|
| FIBER COMPOSITION (MASS PARTS) | MODACRYLIC FIBER A | 13.3 | 15.1 | — | — | — |
| | MODACRYLIC FIBER B | 12.5 | 13 | — | 65 | — |
| | MODACRYLIC FIBER C | 15.1 | 17.8 | 80 | — | — |
| | MODACRYLIC FIBER D | 5.3 | 6.2 | — | — | — |
| | MODACRYLIC FIBER E | 13.3 | 14.8 | — | — | 75 |
| | MODACRYLIC FIBER F | 13.3 | 14.6 | — | — | — |
| | MODACRYLIC FIBER G | 1.5 | 2 | — | — | — |
| | MODACRYLIC FIBER H | 1.1 | 1.1 | — | 35 | — |
| | MODACRYLIC FIBER I | 4.2 | 3.3 | — | — | 25 |
| | MODACRYLIC FIBER J | 3.5 | 2.1 | — | — | — |
| | MODACRYLIC FIBER K | 2.0 | 1.5 | — | — | — |
| | MODACRYLIC FIBER L | 2.0 | 1.7 | — | — | — |

TABLE 2-continued

| | | | | | |
|---|---|---|---|---|---|
| MODACRYLIC FIBER M | 1.6 | 3.0 | 20 | — | — |
| POLYESTER FIBER | 0.6 | 1.1 | — | — | — |
| COLOR DIFFERENCE BETWEEN FIBERS (ΔE) | | | 21.8 | 22.3 | 31.6 |
| DIFFERENCE IN REMAINING SHRINKAGE RATE (%) | | | 14.8 | 16.7 | 11.5 |
| DIFFERENCE IN TIP PORTION LENGTH (cm) | | | 5 | 2.9 | 0.6 |
| GRADATION APPEARANCE | | | A | A | A |
| COLOR DIFFERENCE OF NON-GRADATED PORTION (ΔE) | | | 13.6 | 12.5 | 18.8 |
| COLOR DIFFERENCE OF GRADATED PORTION (ΔE) | | | 7.5 | 6.2 | 8.5 |
| COLOR TONE APPEARANCE | | | DARK BLUE→BROWN | BLACK→ BLUISH BROWN | BEIGE→DARK PURPLE |
| CRIMP APPEARANCE | | | A | A | B |
| DIFFERENCE IN DRY HEAT SHRINKAGE RATE (%) | | | 13.5 | 11.4 | 9.1 |

| | KIND OF FIBER | DRY HEAT SHRINKAGE RATE (%) | REMAINING SHRINKAGE RATE (%) | EXAMPLE 11 | 12 | 13 |
|---|---|---|---|---|---|---|
| FIBER COMPOSITION (MASS PARTS) | MODACRYLIC FIBER A | 13.3 | 15.1 | — | 55 | 25 |
| | MODACRYLIC FIBER B | 12.5 | 13 | — | — | — |
| | MODACRYLIC FIBER C | 15.1 | 17.8 | — | — | — |
| | MODACRYLIC FIBER D | 5.3 | 6.2 | — | — | — |
| | MODACRYLIC FIBER E | 13.3 | 14.8 | — | — | — |
| | MODACRYLIC FIBER F | 13.3 | 14.6 | 75 | — | 25 |
| | MODACRYLIC FIBER G | 1.5 | 2 | 25 | — | — |
| | MODACRYLIC FIBER H | 1.1 | 1.1 | — | — | — |
| | MODACRYLIC FIBER I | 4.2 | 3.3 | — | — | — |
| | MODACRYLIC FIBER J | 3.5 | 2.1 | — | 45 | 25 |
| | MODACRYLIC FIBER K | 2.0 | 1.5 | — | — | — |
| | MODACRYLIC FIBER L | 2.0 | 1.7 | — | — | — |
| | MODACRYLIC FIBER M | 1.6 | 3.0 | — | — | 25 |
| | POLYESTER FIBER | 0.6 | 1.1 | — | — | — |
| COLOR DIFFERENCE BETWEEN FIBERS (ΔE) | | | | 11.3 | 23.4 | 25.8 |
| DIFFERENCE IN REMAINING SHRINKAGE RATE (%) | | | | 12.6 | 13 | 12.1 |
| DIFFERENCE IN TIP PORTION LENGTH (cm) | | | | 3.3 | 1.3 | 2.8 |
| GRADATION APPEARANCE | | | | B | A | A |
| COLOR DIFFERENCE OF NON-GRADATED PORTION (ΔE) | | | | 7.1 | 10.6 | 6.2 |
| COLOR DIFFERENCE OF GRADATED PORTION (ΔE) | | | | 3.1 | 6.9 | 3.2 |
| COLOR TONE APPEARANCE | | | | CHESTNUT BROWN→PALE BROWN | BLACK→ PURPLE | DARK BROWN→ REDDISH BROWN |
| CRIMP APPEARANCE | | | | A | A | A |
| DIFFERENCE IN DRY HEAT SHRINKAGE RATE (%) | | | | 11.8 | 9.8 | 11.7 |

TABLE 3

| | KIND OF FIBER | DRY HEAT SHRINKAGE RATE (%) | REMAINING SHRINKAGE RATE (%) | COMPARATIVE EXAMPLE 1 | 2 | 3 | 4 | 5 |
|---|---|---|---|---|---|---|---|---|
| FIBER COMPOSITION (MASS PARTS) | MODACRYLIC FIBER A | 13.3 | 15.1 | — | — | — | — | 50 |
| | MODACRYLIC FIBER B | 12.5 | 13 | — | — | — | — | — |
| | MODACRYLIC FIBER C | 15.1 | 17.8 | — | — | — | — | — |
| | MODACRYLIC FIBER D | 5.3 | 6.2 | — | — | — | 40 | — |
| | MODACRYLIC FIBER E | 13.3 | 14.8 | — | — | — | — | — |
| | MODACRYLIC FIBER F | 13.3 | 14.6 | — | — | — | — | — |
| | MODACRYLIC FIBER G | 1.5 | 2 | 50 | — | 70 | — | — |
| | MODACRYLIC FIBER H | 1.1 | 1.1 | 50 | 60 | — | — | — |
| | MODACRYLIC FIBER I | 4.2 | 3.3 | — | 40 | — | — | — |
| | MODACRYLIC FIBER J | 3.5 | 2.1 | — | — | 30 | — | — |
| | MODACRYLIC FIBER K | 2.0 | 1.5 | — | — | — | — | 50 |
| | MODACRYLIC FIBER L | 2.0 | 1.7 | — | — | — | — | — |
| | MODACRYLIC FIBER M | 1.6 | 3.0 | — | — | — | 60 | — |
| | POLYESTER FIBER | 0.6 | 1.1 | — | — | — | — | — |
| COLOR DIFFERENCE BETWEEN FIBERS (ΔE) | | | | 6.4 | 17.8 | 17.9 | 0.7 | 0.7 |
| DIFFERENCE IN REMAINING SHRINKAGE RATE (%) | | | | 0.9 | 2.2 | 0.1 | 3.2 | 13.6 |
| DIFFERENCE IN TIP PORTION LENGTH (cm) | | | | 0 | 0.3 | 0.2 | 0.1 | 2.8 |
| GRADATION APPEARANCE | | | | D | C | D | D | D |
| COLOR DIFFERENCE Of GRADATED PORTION (ΔE) | | | | — | 0.2 OR LESS | — | — | — |
| COLOR TONE APPEARANCE | | | | BLUISH BROWN | PURPLE | PURPLE | DARK BROWN | BLACK |
| CRIMP APPEARANCE | | | | D | C | D | D | A |
| DIFFERENCE IN DRY HEAT SHRINKAGE RATE(%) | | | | 0.4 | 3.1 | 2.0 | 3.7 | 11.3 |

Comparative Examples 6 Through 17

Figure 3:
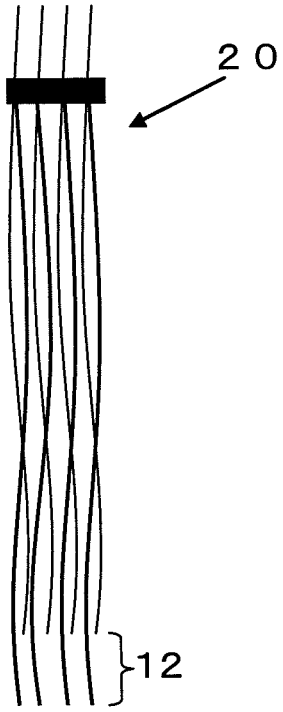
FIG. 3 is a schematic diagram showing a fiber bundle without a heat treatment in Comparative Examples 6 through 17.

Fiber bundles having the same fiber composition as in Examples 1 through 12 were produced, except that, as shown in FIG. 3, a tip portion 12 constituted of fibers having a small shrinkage rate was exposed by a length of 2 cm without performing a heat treatment, in place of exposing a tip portion of fibers having a small shrinkage rate by heat treatment. Gradation appearance of the fiber bundles was evaluated. An evaluation result is shown in Table 4.

TABLE 4

| | COMPARATIVE EXAMPLE | | | | | |
|---|---|---|---|---|---|---|
| | 6 | 7 | 8 | 9 | 10 | 11 |
| COLOR DIFFERENCE BETWEEN FIBERS (ΔE) | 1.0 | 21.5 | 18.7 | 9.1 | 29.6 | 10.5 |
| DIFFERENCE IN TIP PORTION LENGTH (cm) | 2.0 | 2.0 | 2.0 | 2.0 | 2.0 | 2.0 |
| GRADATION APPEARANCE | C | C | C | C | C | C |
| COLOR TONE APPEARANCE | BLACK → PALE BLACK | BLACK → PALE BROWN | DARK BLUE → PURPLE | BROWN → BLUISH BROWN | BEIGE → PURPLE | CHESTNUT BROWN → BROWN |
| CRIMP APPEARANCE | D | D | D | D | D | D |

| | COMPARATIVE EXAMPLE | | | | | |
|---|---|---|---|---|---|---|
| | 12 | 13 | 14 | 15 | 16 | 17 |
| COLOR DIFFERENCE BETWEEN FIBERS (ΔE) | 18 | 21.8 | 22.3 | 31.6 | 11.3 | 23.4 |
| DIFFERENCE IN TIP PORTION LENGTH (cm) | 2.0 | 2.0 | 2.0 | 2.0 | 2.0 | 2.0 |
| GRADATION APPEARANCE | C | C | C | C | C | C |
| COLOR TONE APPEARANCE | BLACK → BROWN | DARK BLUE → BROWN | BLACK → BLUISH BROWN | BEIGE → DARK PURPLE | CHESTNUT BROWN → PALE BROWN | BLACK → PURPLE |
| CRIMP APPEARANCE | D | D | D | D | D | D |

The heat-treated artificial hair fiber bundles obtained in Examples 1 through 13 had a color tone with a gradation effect at the tip portions thereof, and had a crimping property capable of forming a large body.

On the other hand, concerning the fiber bundle of Comparative Example 1, a difference in tip portion length between the fibers was significantly small, and a portion where fibers of one kind out of the fibers of two kinds were exposed was hardly recognized. As a result, the fiber bundle of Comparative Example 1 showed a color tone of bluish brown in its entirety, and substantially no change in color tone was recognized. Concerning the fiber bundle of Comparative Example 2, since a difference in shrinkage rate between the fibers was significantly small, there was no or less difference in tip portion length between the fibers, and fibers of one kind out of the fibers of two kinds were not sufficiently exposed. As a result, the fiber bundle of Comparative Example 2 showed a purple color tone in its entirety, and an obvious color tone change was not recognized, with the density of the purple color being slightly decreased toward the tip portion of the fiber bundle. A color difference at a portion where the color tone was slightly changed was 0.2 or less, and a gradation effect was not substantially recognized. Concerning the fiber bundle of Comparative Example 3, since a difference in shrinkage rate between the fibers was too small to make a difference in tip portion length, and fibers of one kind out of the fibers of two kinds were not sufficiently exposed. As a result, an obvious color tone change was not recognized. Concerning the fiber bundles of Comparative Examples 4 and 5, since the fibers of two kinds had such a small color difference (ΔE) that a color tone difference could hardly be visually recognized, a color tone change was not substantially recognized.

Concerning the fiber bundles of Comparative Examples 6 through 17, each of the fiber bundles was constituted of fibers of two kinds having a color difference (ΔE), with the fibers at a tip portion thereof being displaced from each other by 2 cm. A gradation effect was not recognized in the fiber bundles, and merely a sharp color tone change was recognized.

As described above in detail, an aspect of the invention is directed to a fiber bundle for artificial hair, with one end thereof being bundled and fixed, the fiber bundle comprising: fibers of two or more kinds being heat-treated at a predetermined temperature and having color tones different from each other, wherein the fibers of two or more kinds have heat shrinkage rates different from each other, and a tip portion of a fiber of one kind out of the fibers of two or more kinds emerges in a portion corresponding to the other end of the fiber bundle which is not bundled and fixed. The above arrangement enables to provide an artificial hair fiber bundle having a color tone with a gradation appearance at a tip portion thereof.

Preferably, a fiber of at least one kind out of the fibers of two or more kinds may be crimped or shrunk by the heat treatment. This is advantageous in providing an enhanced gradation effect.

Preferably, a color difference (ΔE) between the color tones different from each other may be 1 or more. This is advantageous in providing an enhanced gradation effect.

Preferably, the emerging portion of the fiber bundle may have a length of 0.5 cm or more. This is advantageous in providing an enhanced gradation effect.

Preferably, a difference in a remaining heat shrinkage rate to be obtained by dry heating at 130° C. between a fiber having a largest remaining shrinkage rate and a fiber having a smallest remaining shrinkage rate, out of the fibers of two or more kinds, may be 5% or more. This is advantageous in providing an enhanced gradation effect.

Preferably, the fibers of two or more kinds may be fibers of two kinds. This is advantageous in easily controlling the color tone.

Preferably, the fibers of two or more kinds may include a modacrylic fiber of at least one kind. This is advantageous in obtaining a fiber bundle having a texture similar to that of human hair.

Another aspect of the invention is directed to a process for producing a fiber bundle for artificial hair, comprising: heat-treating a fiber bundle being bundled and fixed at one end including fibers of two or more kinds having heat shrinkage rates and color tones different from each other at a predetermined temperature to shrink or crimp fibers depending on the respective heat shrinkage rates thereof, whereby a tip portion of a fiber of one kind out of the fibers emerges in a portion corresponding to the other end of the fiber bundle which is not bundled and fixed. The above process enables to easily produce an artificial hair fiber bundle having a color tone with a gradation at a tip portion thereof.

In the above process, preferably, a color difference (ΔE) between the color tones different from each other may be 1 or more. This is advantageous in providing an enhanced gradation effect.

In the above process, preferably, a difference in a dry heat shrinkage rate to be obtained by dry heating at 100° C. between a fiber having a largest dry heat shrinkage rate and a fiber having a smallest dry heat shrinkage rate, out of the fibers of two or more kinds, may be 4% or more. This is advantageous in providing an enhanced gradation effect.

In the above process, preferably, the fibers of two or more kinds may be fibers of two kinds. This is advantageous in easily controlling the color tone.

In the above process, the fibers of two or more kinds may include a modacrylic fiber of at least one kind. This is advantageous in obtaining a fiber bundle having a texture similar to that of human hair.

In the above process, preferably, a difference in a remaining heat shrinkage rate to be obtained by dry heating at 130° C. between a fiber having a largest remaining shrinkage rate and a fiber having a smallest remaining shrinkage rate, out of the fibers of two or more kinds, may be 5% or more. This is advantageous in providing an enhanced gradation effect.

Yet another aspect of the invention is directed to a fiber bundle for artificial hair obtained by the aforementioned process.

Still another aspect of the invention is directed to a head decoration product including the aforementioned fiber bundle for artificial hair.

The invention claimed is:

1. A fiber bundle for artificial hair, with one end thereof being bundled and fixed, the fiber bundle comprising:

fiber groups of two or more kinds being heat-treated at a predetermined temperature and having color tones different from each other, wherein the fiber groups of two or more kinds have heat shrinkage rates different from each other, at least one kind of fiber group out of the fiber groups is crimped or shrunk by the heat treatment, the color difference (ΔE) is 1 or more, a tip portion of a fiber group out of the fiber groups of two or more kinds emerges in a portion corresponding to the other end of the fiber bundle which is not bundled and fixed, the emerging portion of the fiber bundle consists solely of the fibers having a small heat shrinkage rate, and the emerging portion of the fiber bundle has a length of 0.5 cm or more.

2. The fiber bundle for artificial hair according to claim 1, wherein a difference in a remaining heat shrinkage rate to be obtained by dry heating at 130° C. between a fiber group having a largest remaining shrinkage rate and a fiber group having a smallest remaining shrinkage rate out of fiber groups of two or more kinds is 5% or more.

3. The fiber bundle for artificial hair according to claim 1, wherein fiber groups of two or more kinds are fiber groups of two kinds.

4. The fiber bundle for artificial hair according to claim 1, wherein fiber groups of two or more kinds include a modacrylic fiber group of at least one kind.

5. A head decoration product including the fiber bundle for artificial hair according to claim 1.

6. The fiber bundle for artificial hair according to claim 1, wherein the color difference (ΔE) is 15 or more.

7. The fiber bundle for artificial hair according to claim 6, wherein the color difference (ΔE) is 18 or more.

8. The fiber bundle for artificial hair according to claim 1, wherein the color difference (ΔE) is 95 or less.

9. The fiber bundle for artificial hair according to claim 1, wherein the emerging portion of the fiber bundle has a length of 1 cm or more.

10. The fiber bundle for artificial hair according to claim 1, wherein a fiber group having a highest heat shrinkage rate out of the fiber groups has a comparatively dark color, and a fiber group having a low heat shrinkage rate has a comparatively light color.

11. A process for producing a fiber bundle for artificial hair according to claim 1, comprising:

heat-treating a fiber bundle being bundled and fixed at one end including fiber groups of two or more kinds having heat shrinkage rates and color tones different from each other at a predetermined temperature to shrink or crimp fibers depending on the respective heat shrinkage rates thereof, whereby a tip portion of a fiber group of one kind out of the fiber groups emerges in a portion corresponding to the other end of the fiber bundle which is not bundled and fixed, wherein the color difference (ΔE) is 1 or more.

12. The process for producing a fiber bundle for artificial hair according to claim 11, wherein a difference in a dry heat shrinkage rate to be obtained by dry heating at 100° C. between a fiber group having a largest dry heat shrinkage rate and a fiber group having a smallest dry heat shrinkage rate out of the fiber groups of two or more kinds is 4% or more.

13. The process for producing a fiber bundle for artificial hair according to claim 11, wherein fiber groups of two or more kinds are fiber groups of two kinds.

14. The process for producing a fiber bundle for artificial hair according to claim 11, wherein fiber groups of two or more kinds include a modacrylic fiber groups of at least one kind.

15. The process for producing a fiber bundle for artificial hair according to claim 11, wherein a difference in a remaining heat shrinkage rate to be obtained by dry heating at 130° C. between a fiber group having a largest remaining shrinkage rate and a fiber group having a smallest remaining shrinkage rate out of the fiber groups of two or more kinds is 5% or more.

16. A fiber bundle for artificial hair obtained by the process according to claim 11.

* * * * *